US011773581B2

(12) United States Patent
Smith et al.

(10) Patent No.: US 11,773,581 B2
(45) **Date of Patent: *Oct. 3, 2023**

(54) CLEARSPAN FABRIC STRUCTURE

(71) Applicant: Sunbelt Rentals, Inc., Fort Mill, SC (US)

(72) Inventors: George A. Smith, Collierville, TN (US); William C. Sublette, Memphis, TN (US)

(73) Assignee: SUNBELT RENTALS, INC., Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/744,876

(22) Filed: May 16, 2022

(65) Prior Publication Data

US 2022/0275630 A1 Sep. 1, 2022

Related U.S. Application Data

(63) Continuation of application No. 17/169,913, filed on Feb. 8, 2021, now Pat. No. 11,332,919, which is a (Continued)

(51) Int. Cl.
*E04B 1/19* (2006.01)
*E04C 3/40* (2006.01)
(Continued)

(52) U.S. Cl.
CPC ..... *E04B 1/1903* (2013.01); *E04B 1/342* (2013.01); *E04C 3/06* (2013.01); *E04C 3/28* (2013.01);
(Continued)

(58) Field of Classification Search
CPC ..... E04B 1/1903; E04B 1/342; E04C 3/04; E04C 3/40; E04C 3/32; E04C 2003/026;
(Continued)

(56) References Cited

U.S. PATENT DOCUMENTS 2,666,507 A 1/1954 Ruark
4,118,904 A 10/1978 Sprung
(Continued)

FOREIGN PATENT DOCUMENTS

FR 2901820 A1 12/2007

OTHER PUBLICATIONS

"Management of Hazards Associated with Location of Process Plant Tents", American Petroleum Institute (API) Recommended Practice 756, First Edition, Sep. 2014 (34 pages).

*Primary Examiner* — Rodney Mintz
(74) *Attorney, Agent, or Firm* — Kilpatrick Townsend & Stockton LLP

(57) ABSTRACT

A clearspan structure including component systems, and methods of forming a clearspan structure including component systems, for mitigating hazards to personnel or equipment from explosions, fires, toxic material release, and other hazards in hazardous locations. The exemplary clearspan structure is also capable of withstanding environmental conditions such as snow loads and wind. The exemplary clearspan structure is, for example, a tent or fabric structure which includes a plurality of frame members forming a support system for the clearspan structure, and fabric roof portions and walls for enclosing the clearspan structure.

21 Claims, 15 Drawing Sheets

Related U.S. Application Data continuation of application No. 16/429,216, filed on Jun. 3, 2019, now Pat. No. 10,914,060, which is a continuation of application No. 15/966,611, filed on Apr. 30, 2018, now Pat. No. 10,352,033, which is a continuation of application No. 15/078,910, filed on Mar. 23, 2016, now Pat. No. 9,988,805.

(60) Provisional application No. 62/137,562, filed on Mar. 24, 2015.

(51) Int. Cl.

| | |
|---|---|
| ***E04C 3/32*** | (2006.01) |
| ***E04H 15/54*** | (2006.01) |
| ***E04B 1/342*** | (2006.01) |
| ***E04C 3/06*** | (2006.01) |
| ***E04H 15/18*** | (2006.01) |
| ***E04C 3/28*** | (2006.01) |
| ***E04H 15/64*** | (2006.01) |
| ***E04C 3/36*** | (2006.01) |
| ***E04C 3/46*** | (2006.01) |
| ***E04H 15/14*** | (2006.01) |
| ***E04H 15/10*** | (2006.01) |
| ***E04C 3/02*** | (2006.01) |
| ***E04B 1/24*** | (2006.01) |
| ***E04B 1/35*** | (2006.01) |
| ***E04C 3/04*** | (2006.01) |

(52) U.S. Cl.

CPC ..... *E04C 3/32* (2013.01); *E04C 3/36* (2013.01); *E04C 3/40* (2013.01); *E04C 3/46* (2013.01); *E04H 15/10* (2013.01); *E04H 15/14* (2013.01); *E04H 15/18* (2013.01); *E04H 15/54* (2013.01); *E04H 15/644* (2013.01); *E04B 2001/249* (2013.01); *E04B 2001/2415* (2013.01); *E04B 2001/2457* (2013.01); *E04B 2001/2463* (2013.01); *E04B 2001/2487* (2013.01); *E04B 2001/2496* (2013.01); *E04B 2001/3583* (2013.01); *E04C 2003/026* (2013.01); *E04C 2003/043* (2013.01); *E04C 2003/0421* (2013.01); *E04C 2003/0465* (2013.01)

(58) Field of Classification Search

CPC ..... E04C 3/06; E04C 3/28; E04C 3/36; E04H 15/10; E04H 15/54; E04H 15/18; E04H 15/34

See application file for complete search history.

(56) References Cited

U.S. PATENT DOCUMENTS

| | | | | |
|---|---|---|---|---|
| 4,137,687 | A | 2/1979 | Sprung | |
| 4,229,914 | A | 10/1980 | Lucas | |
| 4,773,192 | A | 9/1988 | Andrews | |
| 4,961,297 | A | 10/1990 | Bernard | |
| 4,995,214 | A | 2/1991 | Wolf | |
| 5,115,828 | A * | 5/1992 | Spaulding | E04H 15/34 135/160 |
| 5,167,246 | A | 12/1992 | Mortenson | |
| 5,333,425 | A | 8/1994 | Nickerson | |
| 5,592,789 | A | 1/1997 | Liddell, Sr. | |
| 6,003,280 | A | 12/1999 | Wells | |
| 6,212,850 | B1 | 4/2001 | Branson | |
| 6,247,484 | B1 | 6/2001 | Thomas | |
| 6,502,593 | B1 | 1/2003 | Stafford | |
| 6,691,488 | B2 | 2/2004 | Branson | |
| 6,758,014 | B2 | 7/2004 | Chen | |
| 7,849,639 | B2 | 12/2010 | Sprung | |
| 8,082,700 | B2 | 12/2011 | Kennedy | |
| 8,104,233 | B2 | 1/2012 | Wilsey | |
| 8,381,452 | B1 | 2/2013 | Forsland | |
| 8,528,268 | B1 | 9/2013 | Reaves | |
| 8,627,633 | B2 | 1/2014 | Davies | |
| 8,931,233 | B2 | 1/2015 | Cooper | |
| 9,038,349 | B2 | 5/2015 | Fox | |
| 9,181,723 | B2 | 11/2015 | Schaefer | |
| 9,273,458 | B2 | 3/2016 | Davis | |
| 9,303,426 | B2 | 4/2016 | Workman | |
| 9,988,805 | B1 | 6/2018 | Smith | |
| 10,161,146 | B2 | 12/2018 | Maintz | |
| 10,174,507 | B1 | 1/2019 | Henbid | |
| 10,337,184 | B2 | 7/2019 | Coupe | |
| 10,352,033 | B2 | 7/2019 | Smith | |
| 10,352,034 | B2 | 7/2019 | Boyle | |
| 10,914,060 | B2 | 2/2021 | Smith | |
| 11,332,919 | B2 * | 5/2022 | Smith | E04H 15/14 |
| 2001/0015047 | A1 * | 8/2001 | Branson | E04B 7/022 52/645 |
| 2004/0068938 | A1 * | 4/2004 | Chen | E04C 3/02 52/13 |
| 2005/0252149 | A1 | 11/2005 | Ritchey | |
| 2006/0101730 | A1 * | 5/2006 | Sprung | E04H 15/644 52/82 |
| 2006/0196141 | A1 | 9/2006 | McLean | |
| 2006/0277837 | A1 * | 12/2006 | Wilsey | E04B 1/161 52/79.1 |
| 2008/0178551 | A1 | 7/2008 | Porter | |
| 2008/0178555 | A1 | 7/2008 | Green | |
| 2009/0229645 | A1 | 9/2009 | Hamilton-Jones | |
| 2012/0272607 | A1 * | 11/2012 | Cooper | E04C 3/40 52/707 |
| 2013/0042568 | A1 * | 2/2013 | Davis | E04B 1/342 52/634 |
| 2013/0276382 | A1 * | 10/2013 | Workman | E04B 1/34315 52/63 |
| 2015/0020473 | A1 * | 1/2015 | Fox | E04D 5/146 52/712 |
| 2015/0184380 | A1 | 7/2015 | Yamamoto | |
| 2015/0247316 | A1 * | 9/2015 | Coupe | E04B 1/34384 52/655.1 |
| 2015/0252586 | A1 * | 9/2015 | Schaefer | E04H 15/34 135/121 |
| 2016/0298345 | A1 * | 10/2016 | Maintz | E04H 15/18 |
| 2017/0370091 | A1 | 12/2017 | Dragan | |
| 2018/0209135 | A1 * | 7/2018 | Boyle | E04H 1/005 |
| 2018/0238043 | A1 | 8/2018 | Kuramoto | |
| 2018/0245330 | A1 * | 8/2018 | Smith | E04H 15/644 |
| 2019/0284791 | A1 * | 9/2019 | Smith | E04H 15/14 |
| 2021/0164216 | A1 * | 6/2021 | Smith | E04C 3/46 |

* cited by examiner

CLEARSPAN FABRIC STRUCTURE

CROSS-REFERENCE TO RELATED APPLICATIONS

This application is a continuation application of U.S. patent application Ser. No. 17/169,913 (now issued as U.S. Pat. No. 11,332,919), filed Feb. 8, 2021, which is a continuation application of U.S. patent application Ser. No. 16/429,216 (now issued as U.S. Pat. No. 10,914,060), filed Jun. 3, 2019, which is a continuation application of U.S. patent application Ser. No. 15/966,611 (now issued as U.S. Pat. No. 10,352,033), filed Apr. 30, 2018, which is a continuation application of U.S. patent application Ser. No. 15/078,910 (now issued as U.S. Pat. No. 9,988,805), filed Mar. 23, 2016, which claims priority to U.S. Provisional Patent Application No. 62/137,562, filed Mar. 24, 2015.

BACKGROUND

The present disclosure generally relates to a clearspan structure including component systems, and methods of forming a clearspan structure including component systems. For example and without limitation, the present disclosure relates to clearspan tents and fabric structures used to mitigate hazards to personnel or equipment from explosions, fires, and toxic material release, e.g., at refineries, petrochemical plants, chemical operations, natural gas liquids extraction plants, natural gas liquefaction plants, and other facilities such as those covered by Occupational Safety and Health Standards 29 CFR 1910.119, "Process safety management of highly hazardous chemicals" (2013). Among other things, clearspan structures, systems, and methods according to the present disclosure increase the amount of blast impact from which a blast resistant tent may provide protection, provide greater flexibility for locating the clearspan structure on an industrial site, and meet or exceed related industry requirements for recommended practices such as the American Petroleum Institute Recommended Practice 756 (API RP 756), "Management of Hazards Associated with Location of Process Plant Tents."

The disclosed clearspan structures also withstand potentially destructive environmental conditions caused by, for example, winds and snow loads.

BRIEF SUMMARY OF AN EXEMPLARY EMBODIMENT

For purposes of this disclosure, a "clearspan structure" or "clearspan fabric structure" is defined as a structure incorporating a membrane and a structural support system wherein stresses developed in the tensioned membrane interact with those in the structural support so that the entire assembly acts together to resist the applied load, for example as described by the American Petroleum Institute "Management of Hazards Associated with Location of Process Plant Tents," API Recommended Practice 756, First Edition (September 2014).

The present disclosure generally relates to a clearspan structure including component systems, and methods of forming a clearspan structure including component systems, comprising, in an exemplary embodiment and without limitation, a frame comprising steel and aluminum, and a fabric membrane. An exemplary clearspan structure is, for example, a tent or fabric structure capable of withstanding hazards posed in a toxic-thermal blast zone and environmental conditions such as snow loads and wind.

The exemplary embodiment of a clearspan structure includes a plurality of frame members forming a support, also called a truss, system for the clearspan structure. The frame members of the exemplary embodiment comprise, among other things, base plates, upright posts, rafters, brace bars, eave purlins, ridge purlins, ridge struts, and intermediate purlins. In the exemplary embodiment, the base plates are secured to a foundation or the ground, and the upright posts are connected at one end to the base plates and extend vertically upward therefrom to connect with a first end of the rafters. The rafters are further connected at their first ends to eave purlins and extend upward therefrom to connect at their second ends with ridge purlins. Intermediate purlins are connected to the rafters between the eave and ridge purlins.

The exemplary embodiment further includes brace bars and ridge struts for providing additional strength, rigidity, and/or resilience to the frame. The brace bar includes: a brace bar saddle to upright that is connected to a frame member such as an upright post; a hollow structural section connected at one end of the hollow structural section to the brace bar saddle to upright and at another end to a brace bar extension; and, a brace bar saddle to rafter that is connected to each of the brace bar extension and a frame member such as a rafter. The ridge struts include two ridge strut saddles that respectively connect to opposing rafters at the peak of the clearspan structure.

Exemplary disclosed embodiments of a clearspan structure such as a blast tent further include roof fabric and fabric walls formed from double flap keder fabric. The double flap keder fabric provides reinforced protection from forces associated with blasts, wind, and snow, among other things. The roof fabric and fabric walls are respectively connected between adjacent rafters and upright posts to cover and enclose the frame of the clearspan structure. In the exemplary embodiment the roof fabric and fabric walls include keder edges that connect to keder tracks on the frame members.

The exemplary clearspan structure may also include additional components such as cable braces connecting frame members for providing extra strength, rigidity, or other desired properties to the structure; stake bars for distributing forces at base plates to further resist uplift and shear forces, and/or; hanging light assemblies having primary and backup connections to a rafter for preventing the light assembly from detaching and falling.

These and additional objects of the disclosure will be readily apparent to one of ordinary skill in the art, based on the detailed description which follows.

There has thus been outlined some of the features of the structure, systems, and methods, in order that the detailed description thereof may be better understood. One of ordinary skill in the art will understand that the disclosure is not limited in its application to the details of the arrangements, interactions of the components, or steps set forth in the following description or illustrated in the drawings. The structure, systems, and methods are capable of other embodiments, and of being practiced and carried out in various ways, without departing from the scope of the disclosure. Also, it should be understood that the phraseology and terminology employed herein are for the purpose of the description and should not be regarded as limiting.

To the accomplishment of the above and related objects, the structure, systems, and methods may be embodied in the form illustrated in the accompanying drawings, attention being called to the fact, however, that the drawings are illustrative only, and that changes may be made in illustrated structures and systems described within the scope of the disclosure.

BRIEF DESCRIPTION OF THE DRAWINGS

The features and advantages of the exemplary embodiments may be better and more completely understood with reference to the attached drawings in which corresponding reference symbols indicate corresponding parts, and in which.

DETAILED DESCRIPTION OF AN EXEMPLARY EMBODIMENT

Figure 1:
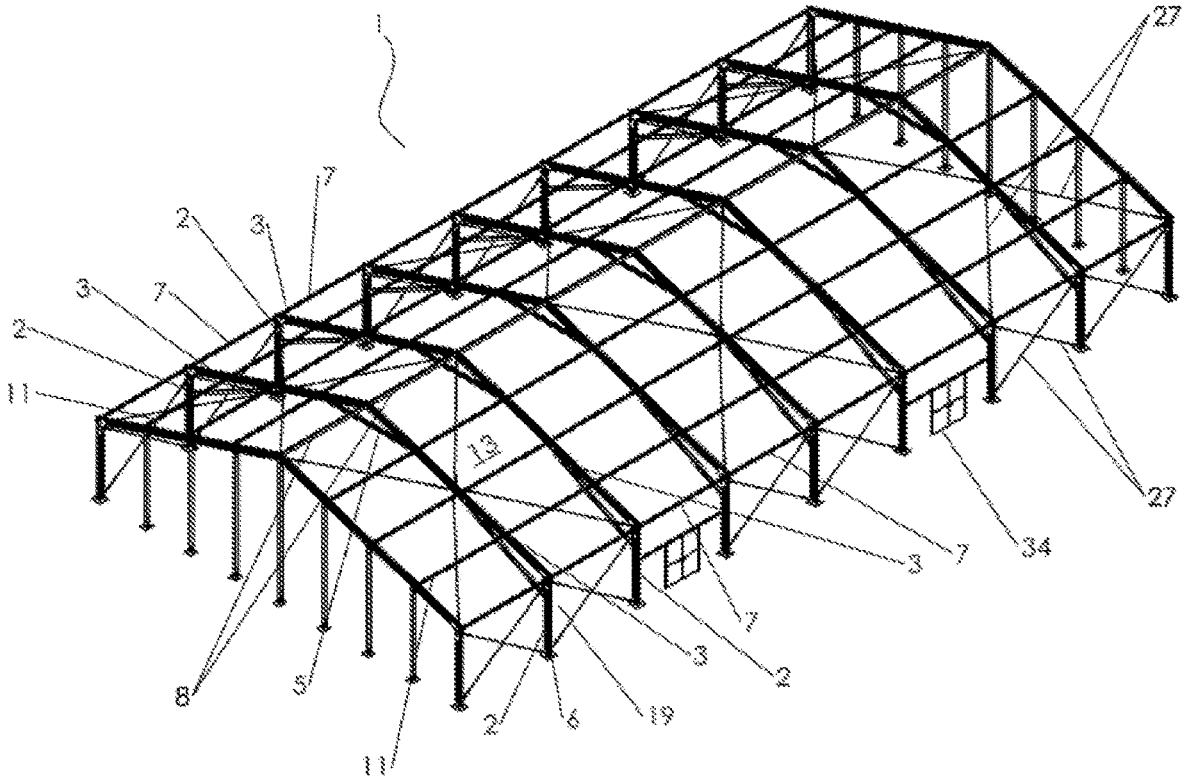
FIG. 1 shows an exemplary embodiment of clearspan structure according to the current disclosure.

With reference now to the drawings, the figures illustrate exemplary embodiment(s) of a clearspan structure including component systems of a clearspan structure. An exemplary method of forming such structure and systems will be apparent to one of ordinary skill in the art based on, for example, the disclosed fabrication, configuration, and fastening of such structure and systems, without limitation thereto.

With reference to FIGS. 1-4, an exemplary embodiment of a clearspan structure 1 is shown. The clearspan structure comprises, among other things, frame members such as upright posts 2, rafters 3, brace bars 4, ridge struts 5, base plates 6, eave purlins 7, ridge purlins 8, and intermediate purlins 11. Further, clearspan structure 1 comprises roof fabrics 13 and fabric walls 19 for enclosing the clearspan structure 1, and, in an exemplary embodiment, fabric doors 34 for providing access to the clearspan structure 1. In addition, the exemplary embodiment of the clearspan structure 1 includes cable braces 27 for providing additional stability to the clearspan structure 1.

With continuing reference to the exemplary embodiment of the exemplary frame for a clearspan structure 1 shown in FIGS. 1-4, each upright post 2 is secured at one end to a base plate 6 which is secured to a foundation or to the ground. In the exemplary disclosed embodiment, upright posts 2 have a 300 mm×100 mm nominal dimension and are spaced at approximately 2.5 m increments across the span width of the clearspan structure 1. Other sizes, weights, and spacing for upright posts 2 may be used to achieve particular properties for particular structures.

Figure 5:
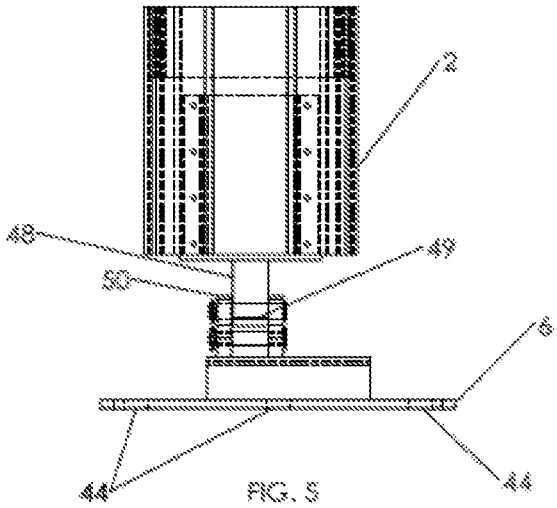
FIG. 5 shows an exemplary base plate connection for the clearspan structure.

In the exemplary embodiment shown by FIG. 5, upright posts 2 are connected to base plates 6 by a steel insert 48 with a guide hole 49. The guide hole 49 fits into a mating slot 50 on the top side of the base plate 6, where a bolt (unnumbered) is inserted through the slot 50 and guide hole 49. In other embodiments, upright posts 2 may be directly connected to base plates 6 using bolts, screws, welding, or other known techniques. Alternatively, upright posts 2 may be integrally formed with base plates 6.

Base plate 6 may be secured to a foundation or to the ground using anchors such as straight stakes and/or helical anchors passed through anchoring apertures 44 (see FIG. 31), embedded systems, concrete anchors (for pads, ringbeams, piers, etc.), mechanical anchors (drop-in or expansion anchor types), chemical anchors, or by any technique consistent with this disclosure and particular ground conditions on site locations.

Upright posts 2 and base plates 6, as well as other frame members indicated above and described in further detail below, are made from steel and/or aluminum in the exemplary disclosed embodiments. In the same or other embodiments, the frame members may be made from other metals, alloys, plastics, or other materials consistent with this disclosure.

With continuing reference to FIGS. 1-4, the upright post 2 extends upward from the base plate 6 and connects at a second end of the upright post 2 to a first end of a rafter 3. With specific reference now to the exemplary embodiment shown in FIG. 3, and further in FIGS. 6-7, each upright post 2 is connected to a rafter 3 using a bracket 35 that spans and connects to each of the upright post 2 and rafter 3. In the exemplary embodiment, brackets 35 are secured to upright post 2 and rafter 3 using bolts 36 that extend through upright post 2 and rafter 3 and secure a second bracket 35 to an opposite side of upright post 2 and rafter 3 using nuts 37. In other embodiments, brackets 35 may be secured using screws, welding, or other known techniques consistent with this disclosure. In still further embodiments, upright post 2 and rafter 3 may be integrally formed.

Figure 2:
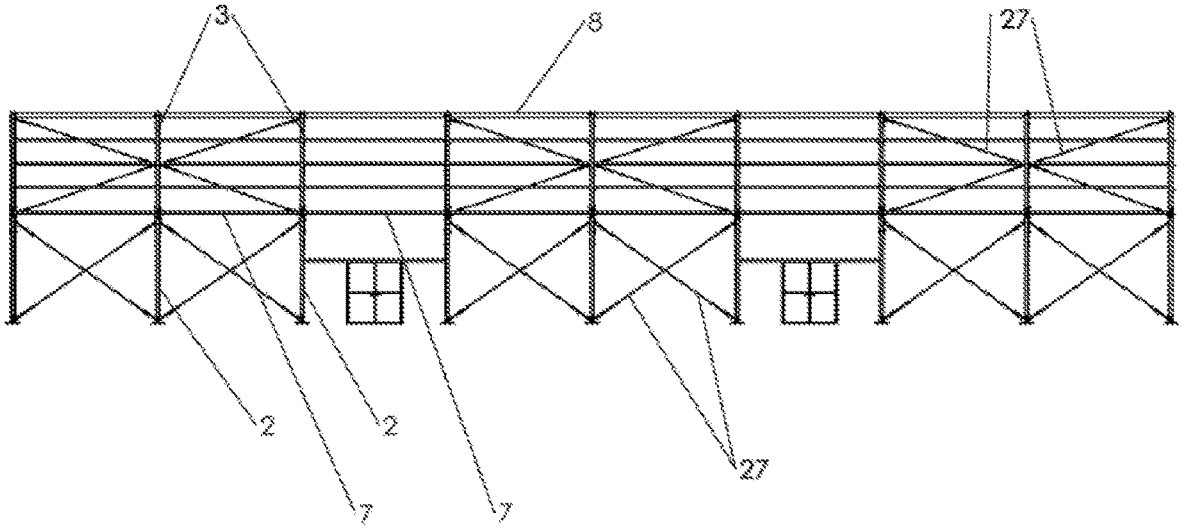
FIG. 2 shows a front view of the exemplary clearspan structure.
Figure 6:
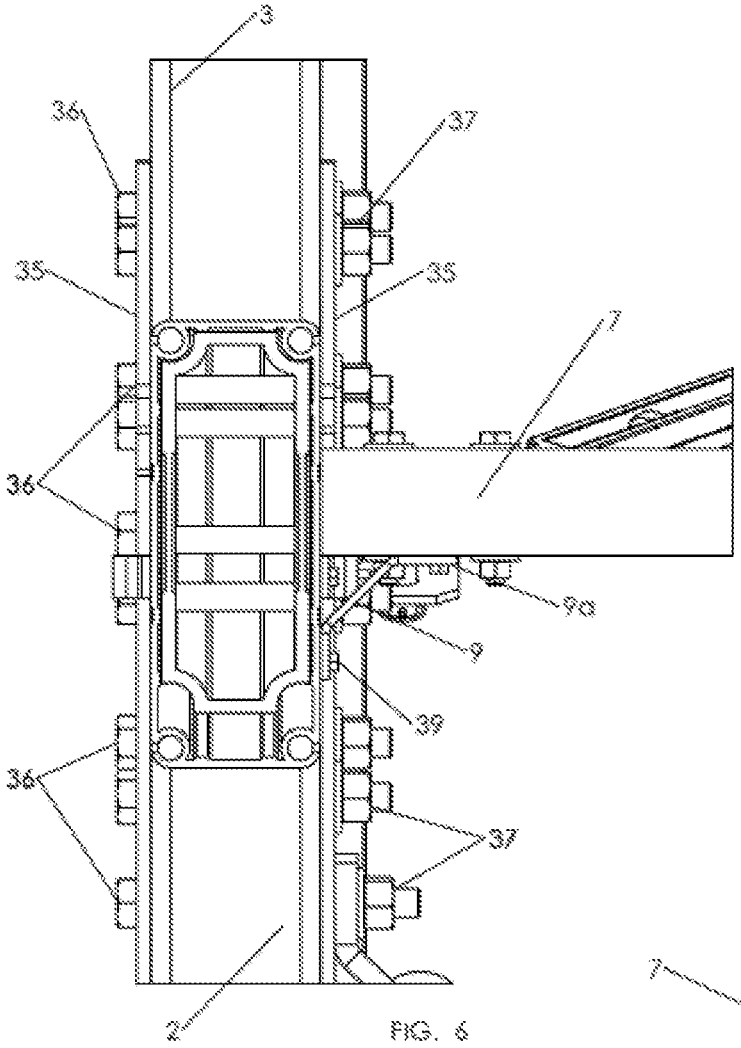
FIG. 6 shows an exemplary connection of a rafter, upright post, and cave purlin for the clearspan structure.
Figure 7:
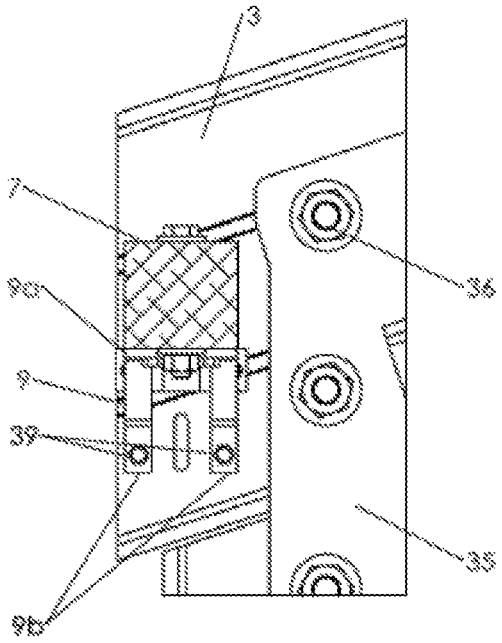
FIG. 7 shows an exemplary cave purlin connection for the clearspan structure.
Figure 8:
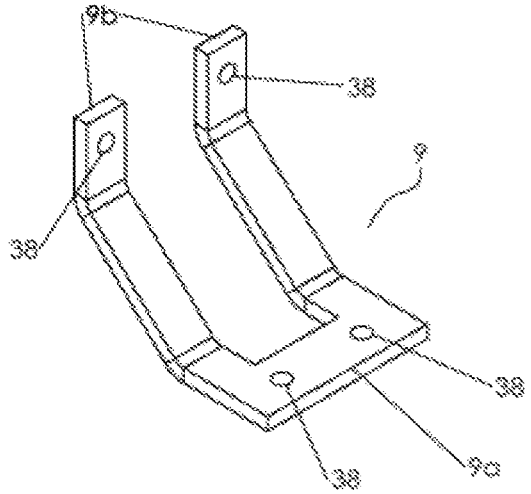
FIG. 8 shows an exemplary cave purlin bracket for the clearspan structure.

With continuing reference to the exemplary embodiments of FIGS. 1-2, and with further reference to FIGS. 6-7, in the exemplary embodiment the first end of each rafter 3 is also connected to an eave purlin 7. An exemplary connection of a rafter 3 to an eave purlin 7 is shown in FIGS. 6-7. Eave purlin 7 abuts rafter 3 and is secured thereto using an eave purlin bracket 9 as shown in FIGS. 6-8. The exemplary eave purlin bracket 9 of FIG. 8 has a bent-U shape and includes fastener apertures 38 for accommodating a fastener such as a screw, bolt, rivet, or other known fastener.

As shown in the view along the rafter 3 of FIG. 6 and the view along the eave purlin 7 of FIG. 7, the exemplary eave purlin bracket 9 is respectively connected to the eave purlin 7 at the base 9*a* of the eave purlin bracket 9 and to the rafter 3 at the arms 9*b* of the eave purlin bracket 9. In the exemplary embodiment, eave purlin bracket 9 is connected to the eave purlin 7 and rafter 3 using self-tapping screws 39 that extend through fastener apertures 38 on the eave purlin bracket 9. In other embodiments, eave purlin bracket 9 may be connected to eave purlin 7 and rafter 3 using any known method consistent with this disclosure, such as welding or clamping.

Figure 3:
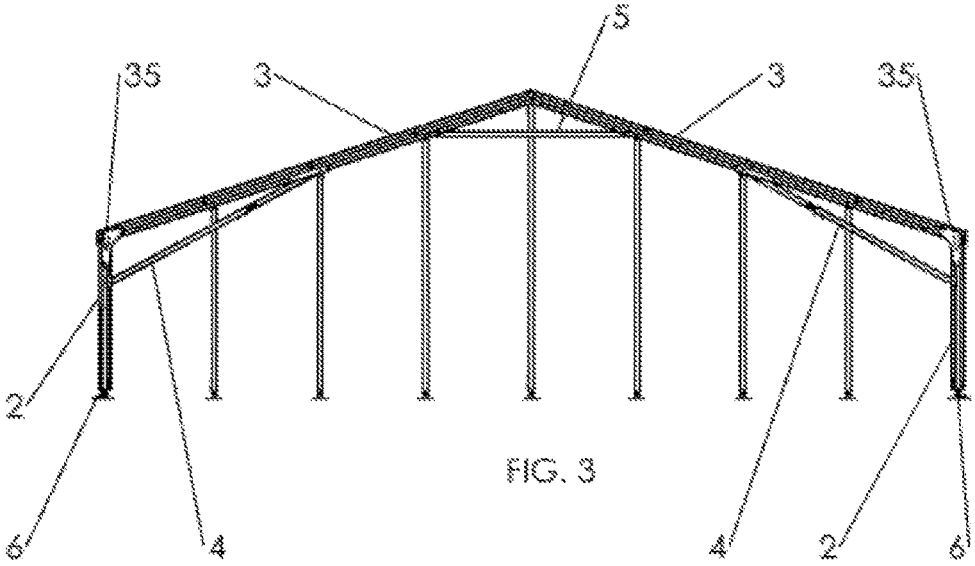
FIG. 3 shows a side view and exemplary frame portion of the exemplary clearspan structure.
Figure 9:
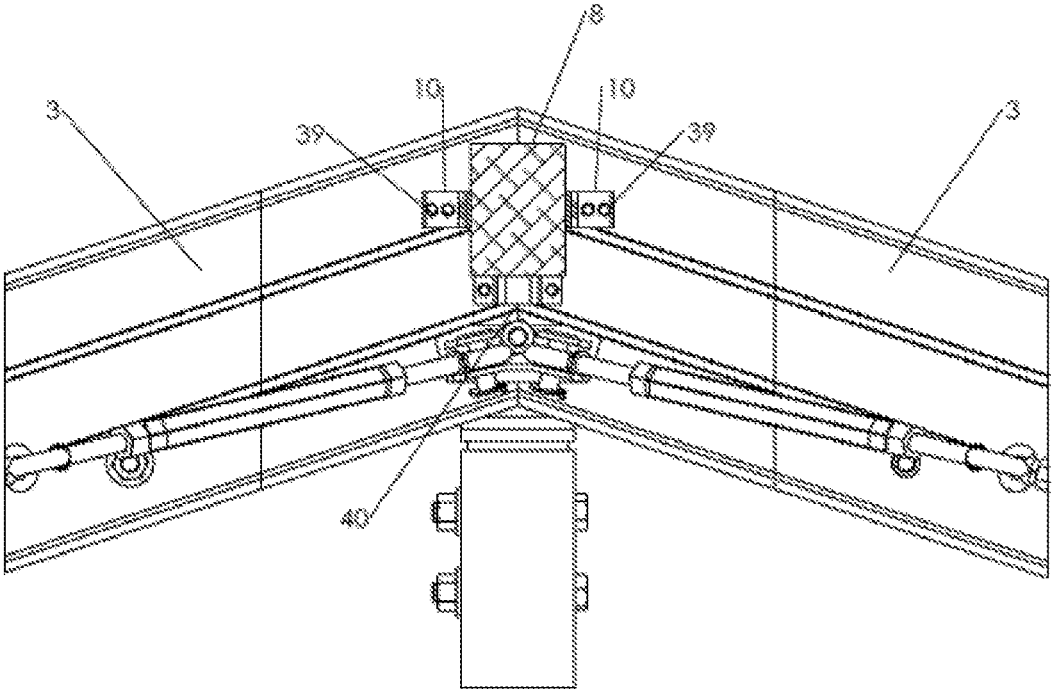
FIG. 9 shows an exemplary ridge purlin connection for the clearspan structure.

With continuing reference to FIGS. 1-3 and the frame of the clearspan structure 1, rafters 3 extend from upright posts 2 and eave purlins 7 to ridge purlins 8. An exemplary connection between rafters 3 and a ridge purlin 8 is shown in FIG. 9. In the view along the ridge purlin 8 of FIG. 9, ridge purlin 8 abuts two rafters 3 which connect at respective ends of the rafters 3. The ridge purlin 8 connects to each rafter 3 using a ridge bracket 10 (FIG. 10) on each of two opposite sides of the ridge purlin 8, and a hook bracket 40 (FIG. 11) in conjunction with a bracket hook 41 (FIG. 12). The rafters 3 may be joined via their connections to the ridge purlin 8, or in any manner consistent with this disclosure, such as with screws, bolts, brackets, welding, clamping, or other known techniques.

Figure 10:
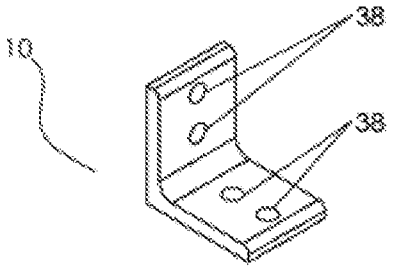
FIG. 10 shows an exemplary ridge purlin bracket for the clearspan structure.

With continuing reference to FIGS. 9-10, in the exemplary embodiment ridge bracket 10 is L-shaped. The exemplary ridge bracket 10 includes fastener apertures 38 for connecting the ridge bracket to each of the ridge purlin 8 and the rafters 3 via self-tapping screws 39 that pass through the fastener apertures 38 of ridge bracket 10. In the exemplary embodiment, one end of ridge bracket 10 is secured to the ridge purlin 8 and the other end of ridge bracket 10 is secured to rafter 3. In other embodiments, ridge bracket 10 may be of any shape or form consistent with this disclosure, and may be secured to ridge purlin 8 and rafter 3 using any known connecting means consistent with this disclosure, such as screws, bolts, welding, clamping, or other known means.

Figure 11:
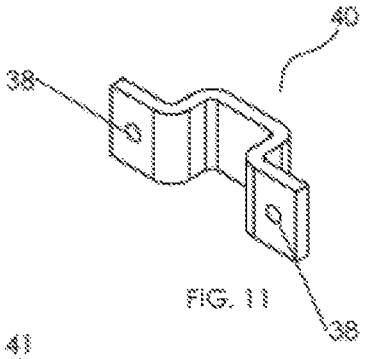
FIG. 11 shows an exemplary hook bracket for the clearspan structure.
Figure 12:
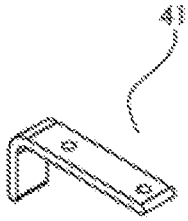
FIG. 12 shows an exemplary bracket hook for the clearspan structure.
Figure 13:
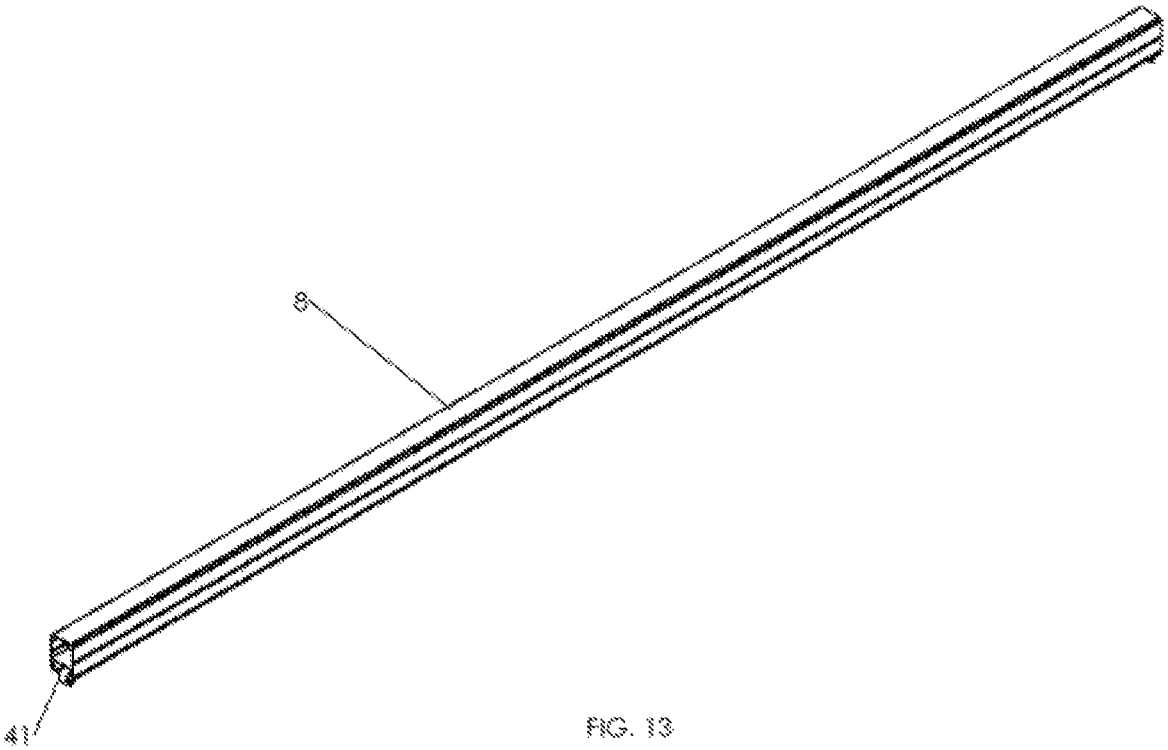
FIG. 13 shows an exemplary ridge purlin for the clearspan structure.

With continuing reference to FIG. 9, and further reference to FIGS. 11-13, an exemplary hook bracket 40 and bracket hook 41 for securing ridge purlin 8 are shown. Bracket hook 41 is connected to, and extends perpendicularly from, ridge purlin 8. Thus, when ridge purlin 8 is connected to rafters 3, the extending portion of bracket hook 41 will be substantially flush with rafters 3 and hook bracket 40 is configured to attach on either side of, and retain, the extending portion of bracket hook 41.

Figure 14:
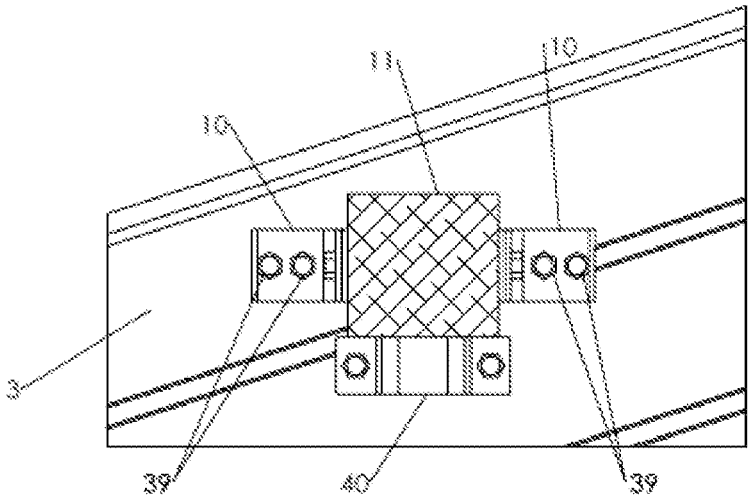
FIG. 14 shows an exemplary intermediate purlin connection for the clearspan structure.

FIG. 14 shows an exemplary connection between an intermediate purlin 11 and a rafter 3. In the exemplary embodiment, intermediate purlin 11 has substantially the same structure as ridge purlin 8 and attaches to rafter 3 using ridge brackets 10, hook bracket 40, and bracket hook 41 in generally the same assembly as previously described with respect to the exemplary connection between the rafters 3 and ridge purlin 8.

Figure 15:
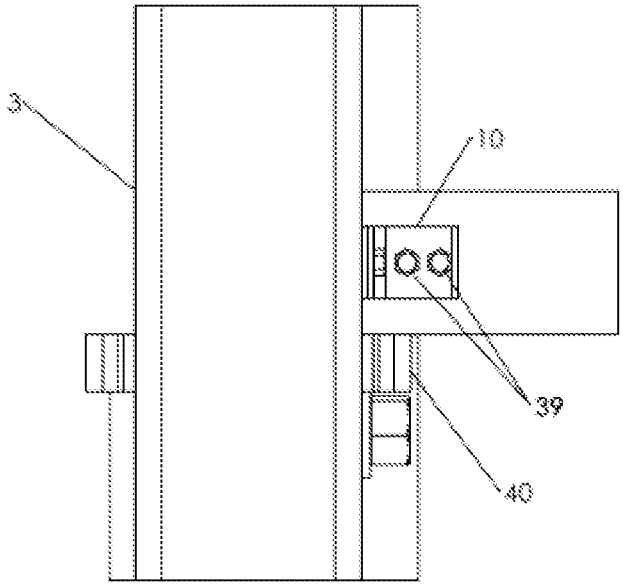
FIG. 15 shows a side view of an exemplary ridge purlin connection for the clearspan structure.

FIG. 15 shows a side view of the exemplary connection between a ridge purlin 8 and rafter 3 as shown in FIG. 9 (and similarly between an intermediate purlin 11 and rafter 3 as shown in FIG. 14).

In the exemplary embodiment(s) described above, eave purlin bracket 6, ridge bracket 9, hook bracket 40, and bracket hook 41 are formed from extruded, hollow aluminum. In the same or other embodiments, any or all of these components may be formed from other metals, alloys, plastics, or other materials consistent with this disclosure.

Figure 4:
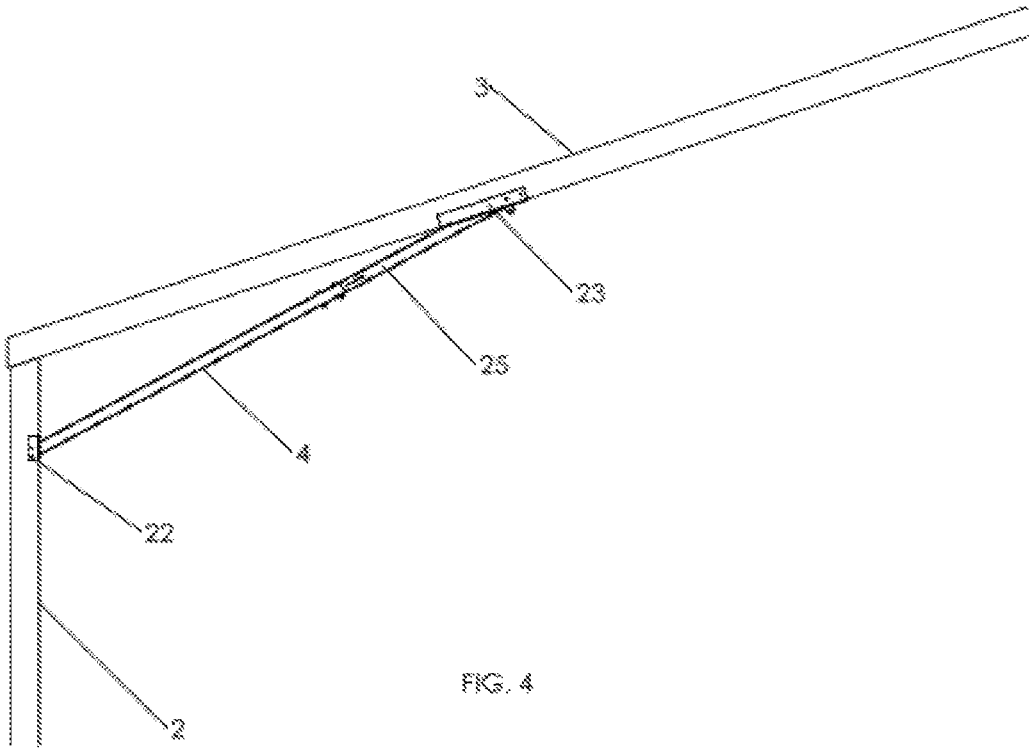
FIG. 4 shows an exemplary brace bar and assembly for the clearspan structure.
Figure 16:
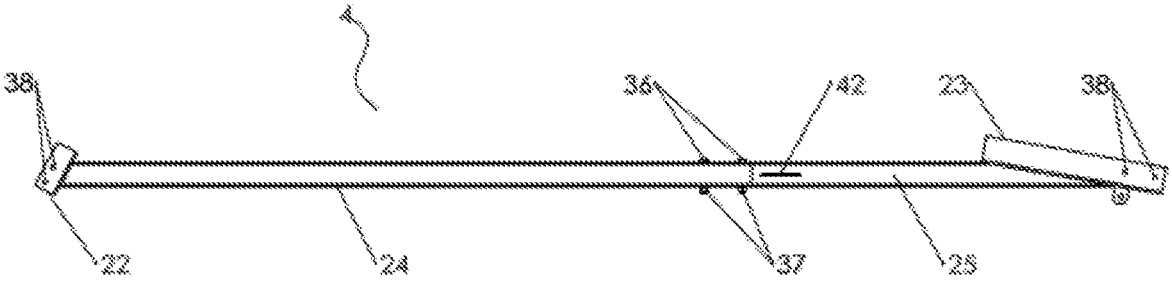
FIG. 16 shows an exemplary brace bar for the clearspan structure.
Figure 17:
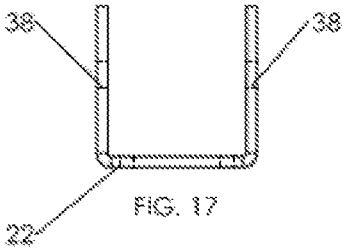
FIG. 17 shows an exemplary brace bar saddle to upright for the clearspan structure.
Figure 18:
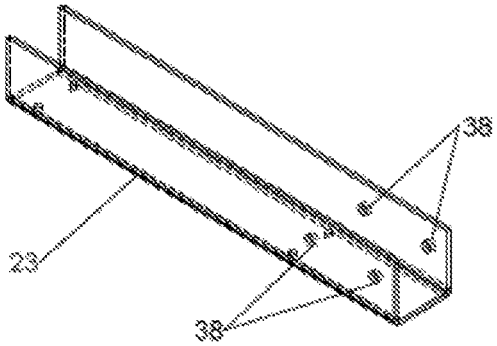
FIG. 18 shows an exemplary brace bar saddle to rafter for the clearspan structure.

With reference now to FIG. 16, and continuing reference to FIGS. 3-4, the exemplary embodiment of a clearspan structure 1 includes brace bars 4 connected between upright posts 2 and rafters 3 for providing additional stability and support to the clearspan structure 1. The exemplary brace bar 4, shown in FIG. 16, includes a brace bar saddle to upright 22 as shown in FIG. 17 for connecting to the upright post 2, and a brace bar saddle to rafter 23 as shown in FIG. 18 for connecting to the rafter 3. The brace bar 4 further includes a hollow structural section 24 connected at a first end to the brace bar saddle to upright 22 and at a second end to a brace bar extension 25. The brace bar extension 25 is further connected to the brace bar saddle to rafter 23. In other embodiments, brace bar saddle to upright 22 and brace bar saddle to rafter 23 may be connected by a single component, for example and without limitation, a hollow structural section or other component consistent with this disclosure that extends between the brace bar saddle to upright 22 and the brace bar saddle to rafter 23.

The exemplary brace bar saddle to upright 22 shown in FIG. 17 has a U-shape. In other embodiments, brace bar saddle to upright 22 may generally have any shape or form consistent with this disclosure. In the exemplary embodiment, the U-shaped brace bar saddle to upright 22 may, for example and without limitation, be connected to each side of a substantially rectangular upright post 2 and secured thereto using screws, bolts, or other known fasteners passed through fastener apertures 38 on brace bar saddle to upright 22. In other embodiments, bracebar saddle to upright 22 may be connected to a frame member by welding, clamping, or other known connecting means, or may be integrally formed with a frame member.

The brace bar saddle to upright 22 is also connected to the hollow structural section 24, as shown in FIG. 16. In the exemplary embodiment shown by FIG. 16, brace bar saddle to upright 22 is welded to the hollow structural section 24 at an appropriate angle to allow attachment of the brace bar saddle to upright 22 to upright post 2. In other embodiments, brace bar saddle to upright 22 and hollow structural section 24 may be connected by bolting, clamping, or other known connecting means, or may be integrally formed.

With continuing reference to FIG. 16, hollow structural section 24 and brace bar extension 25 are connected. As shown in the exemplary embodiment of FIG. 16, hollow structural section 24 and brace bar extension 25 are connected by bolts 36 and nuts 37, and/or by a weld through slot 42 in the hollow structural section 24. In other embodiments, hollow structural section 24 and brace bar extension 25 may be connected by any other known means consistent with this disclosure, or may be integrally formed. In still further embodiments, brace bar extension 25 may be configured to move relative to hollow structural section 24, for example by sliding along a length of hollow structural section 24.

With continuing reference to FIG. 16, brace bar extension 25 extends from hollow structural section 24 and further connects to brace bar saddle to rafter 23. In the exemplary embodiment shown in FIG. 18, brace bar saddle to rafter 23 has an elongate U-shape. In other embodiments, brace bar saddle to rafter 23 may generally have any shape or form consistent with this disclosure. In the exemplary embodiment, the U-shaped brace bar saddle to rafter 23 may be connected to each side of a substantially rectangular rafter 3 and secured thereto using screws, bolts, or other known fasteners passed through fastener apertures 38 on brace bar saddle to rafter 23. In other embodiments, brace bar to saddle to rafter 23 may be connected to a frame member by welding, clamping, or other sufficient connection means, or may be integrally formed with a frame member.

In the exemplary embodiment shown by FIG. 16, brace bar saddle to rafter 23 is welded to the brace bar extension 25 at an appropriate angle to allow attachment of the brace bar saddle to rafter 23 to rafter 3. In other embodiments, brace bar saddle to rafter 23 and brace bar extension 25 may be connected by bolting, clamping, or other known connecting means, or may be integrally formed.

In the exemplary embodiment of brace bar 2 described above, the components of brace bar 2 are made from galvanized steel such as according to standard ASTM A922 ("Standard Specification for Silicon Metal"). In the same or other embodiments, components of brace bar 2 may be made from other metals, alloys, plastics, or other materials consistent with this disclosure.

Figure 19:
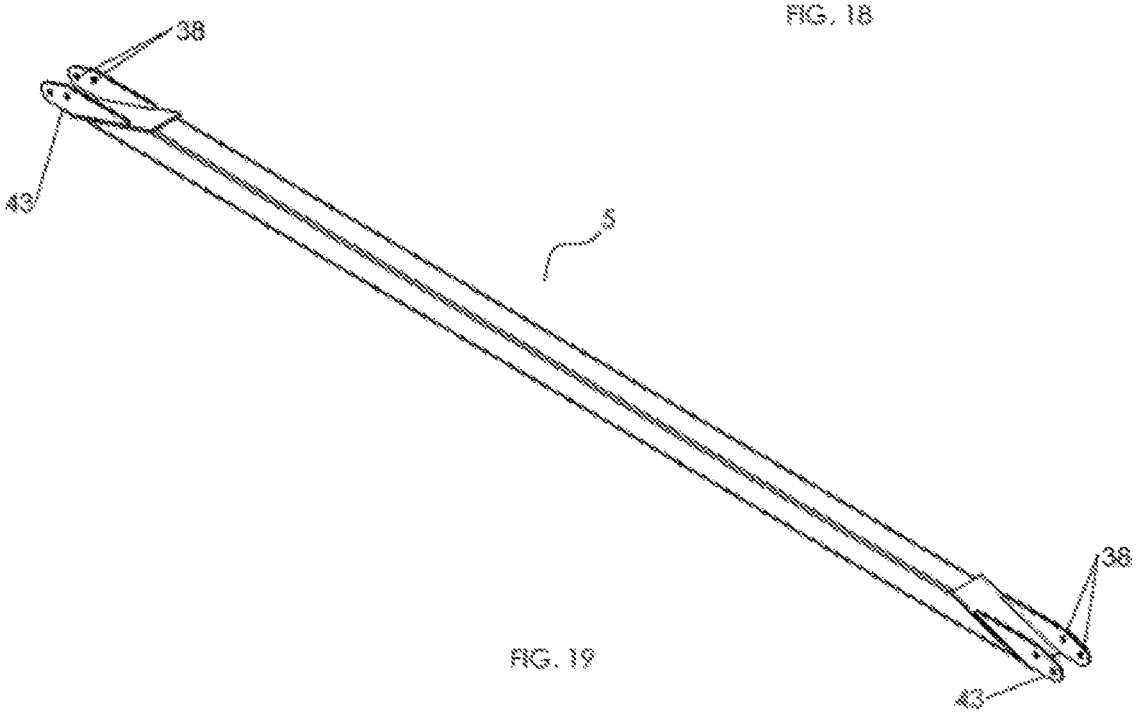
FIG. 19 shows an exemplary ridge strut for the clearspan structure.

With reference now to FIG. 19, and continuing reference to FIG. 3, the exemplary embodiment of a clearspan structure further includes ridge struts 5 connected between opposing rafters 3 for providing additional stability and support to the clearspan structure 1. In the exemplary embodiment of FIG. 19, ridge strut 5 is an elongate strut having a ridge strut saddle 43 at each of first and second ends. As previously shown in FIG. 3, the ridge strut 5 spans and connects to opposing rafters 3 via ridge strut saddles 43 which, in the exemplary embodiment, are U-shaped structures that may fit over opposing sides of a substantially rectangular rafter 3 and be connected thereto by screws or bolts through fastener apertures 38, or by welding or other known connection means. Ridge strut 5 may also be integrally formed with a frame member.

In the exemplary embodiment, components of ridge strut 5 are made from galvanized steel such as according to standard ASTM A922 ("Standard Specification for Silicon Metal"). In the same or other embodiments, components of ridge strut 5 may be made from other metals, alloys, plastics, or other materials consistent with this disclosure. Further, ridge strut 5, and ridge strut saddles 43 may be of any shape or form consistent with this disclosure.

Figure 20:
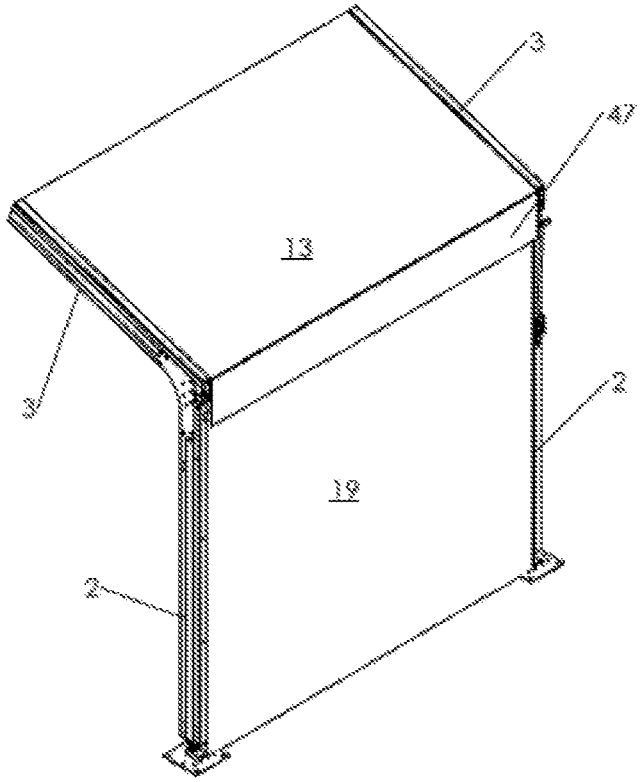
FIG. 20 shows exemplary fabric portions for the clearspan structure.
Figure 21:
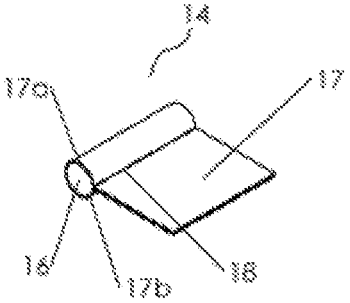
FIG. 21 shows an exemplary fabric for the clearspan structure.
Figure 22:
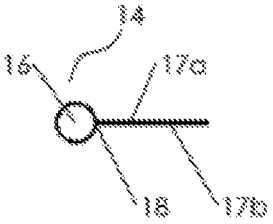
FIG. 22 shows an exemplary fabric for the clearspan structure.
Figure 23:
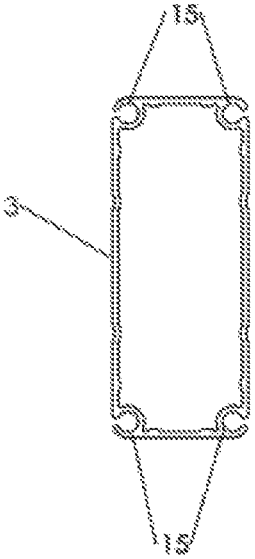
FIG. 23 shows an exemplary fabric connection for the clearspan structure.
Figure 24:
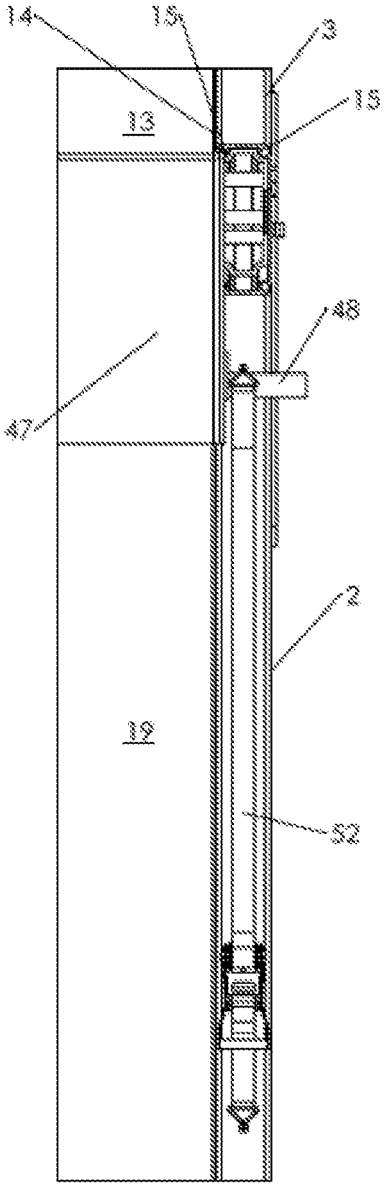
FIG. 24 shows an exemplary fabric connection for the clearspan structure.

With reference now to FIG. 20, the exemplary embodiment of a clearspan structure 1 has roof fabric 13 and fabric walls 19 for enclosing the clearspan structure 1 and frame. In the exemplary embodiment, roof fabric 13 and fabric walls 19 are double flap keder fabric having double flap reinforcement. As shown in FIGS. 21-22, the exemplary double flap keder fabric is formed by wrapping a first surface 17*a* and a second surface 17*b* of a keder material 17 around a dowel 16. The first surface 17*a* and second surface 17*b* surface of the keder material 17 are joined, for example by high-frequency RF welding, to form a secure pocket 18 for containing the dowel 16 and thereby form a keder edge 14 on the material.

In the exemplary embodiment of FIGS. 21-22, keder material 17 is a polyester 19 oz., white, denier 2000×2000 keder fabric with a thickness of 0.70 mm and a coating thickness of 0.20 mm. In other embodiments, the keder material 17 may be any material consistent with the scope of this disclosure, for example and without limitation, a material that meets the American Petroleum Institute "Management of Hazards Associated with Location of Process Plant Tents," API Recommended Practice 756, First Edition (September 2014).

With continuing reference to FIG. 20 and further reference to FIGS. 23-29, roof fabrics 13 and fabric walls 19 are connected to frame members of the exemplary clearspan structure 1 to enclose the clearspan structure 1. In the exemplary embodiment shown by FIGS. 23-24, keder edges 14 of roof fabric 13 are received by, and lock into, keder tracks 15 in rafters 3. Roof fabric 13 extends over eave purlin 7 to form roof fabric flap 47. As shown in the exemplary cutaway view of fabric flap 47 in FIG. 25, the exemplary roof fabric flap 47 includes a pocket 51 formed, e.g., by looping the end of the roof fabric flap 47 and welding the loop in place. As further shown in the exemplary embodiment of FIGS. 24-25, a steel bar 48 passes through pocket 51 and is retained by a ratchet strap 52 attached to upright post 2, for keeping the roof fabric flap 47 and roof fabric 13 from flapping, moving, and/or becoming dislodged.

Figure 25:
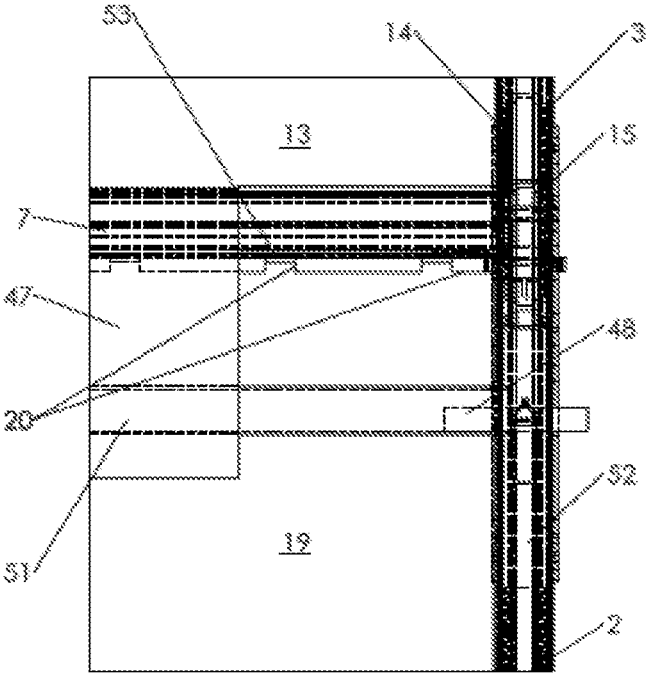
FIG. 25 shows an exemplary cutaway view of a fabric flap for the clearspan structure.
Figure 26:
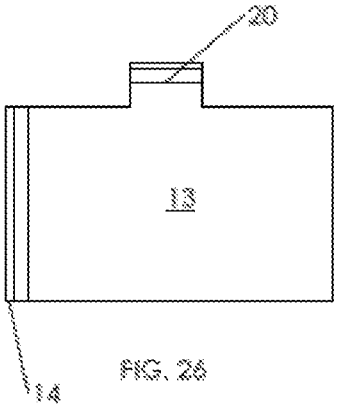
FIG. 26 shows an exemplary fabric wall for the clearspan structure.
Figure 27:
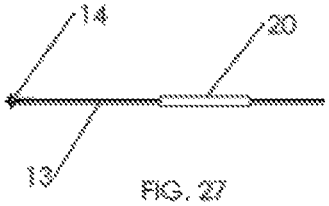
FIG. 27 shows a top view of an exemplary fabric wall for the clearspan structure.
Figure 28:
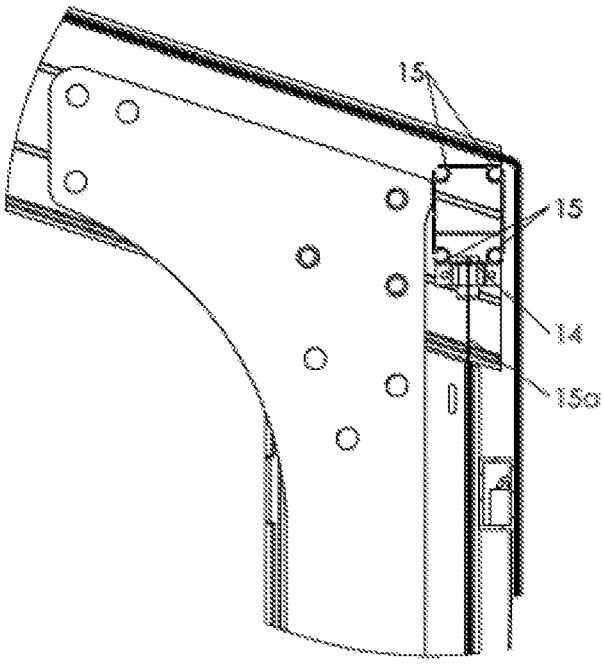
FIG. 28 shows an exemplary fabric connection for the clearspan structure.
Figure 29:
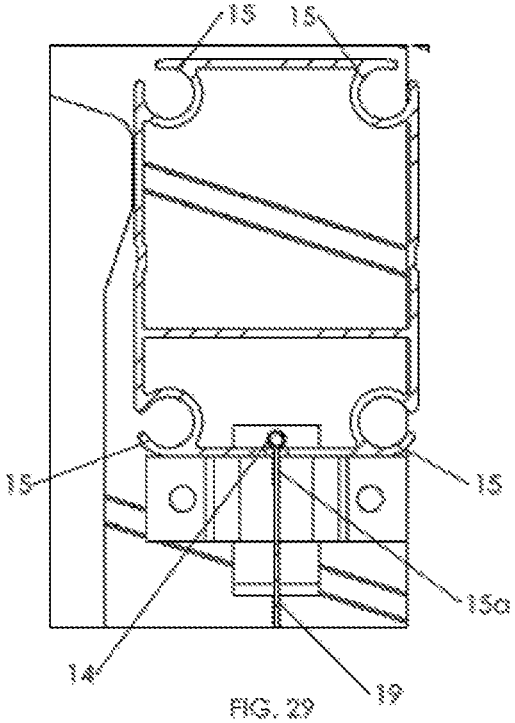
FIG. 29 shows an exemplary fabric connection for the clearspan structure.

With continuing reference to FIG. 25, and additional reference now to FIGS. 26-29, fabric walls 13 include keder edges 14 as previously described, and an edge having tabs 20 extending from the fabric wall 13. As shown in the exemplary embodiment of FIGS. 25-29, keder edges 14 of the fabric wall 13 are received by, and lock into, keder tracks 15*a* on the upright posts 2. Tabs 20 on the fabric wall 13 are received by, and lock into, a corresponding track 53 on eave purlins 7.

Figure 30:
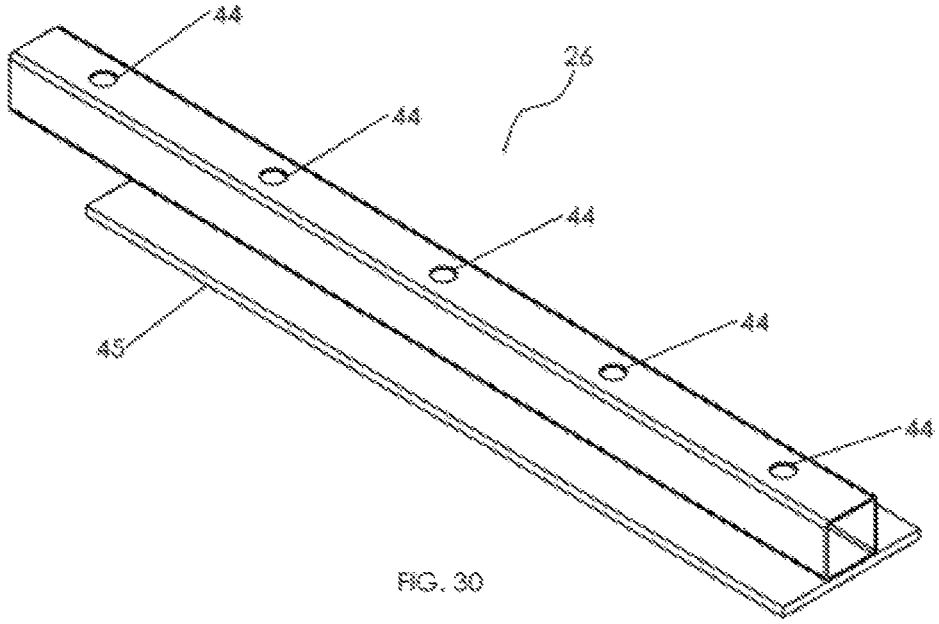
FIG. 30 shows an exemplary stake bar for the clearspan structure.
Figure 31:
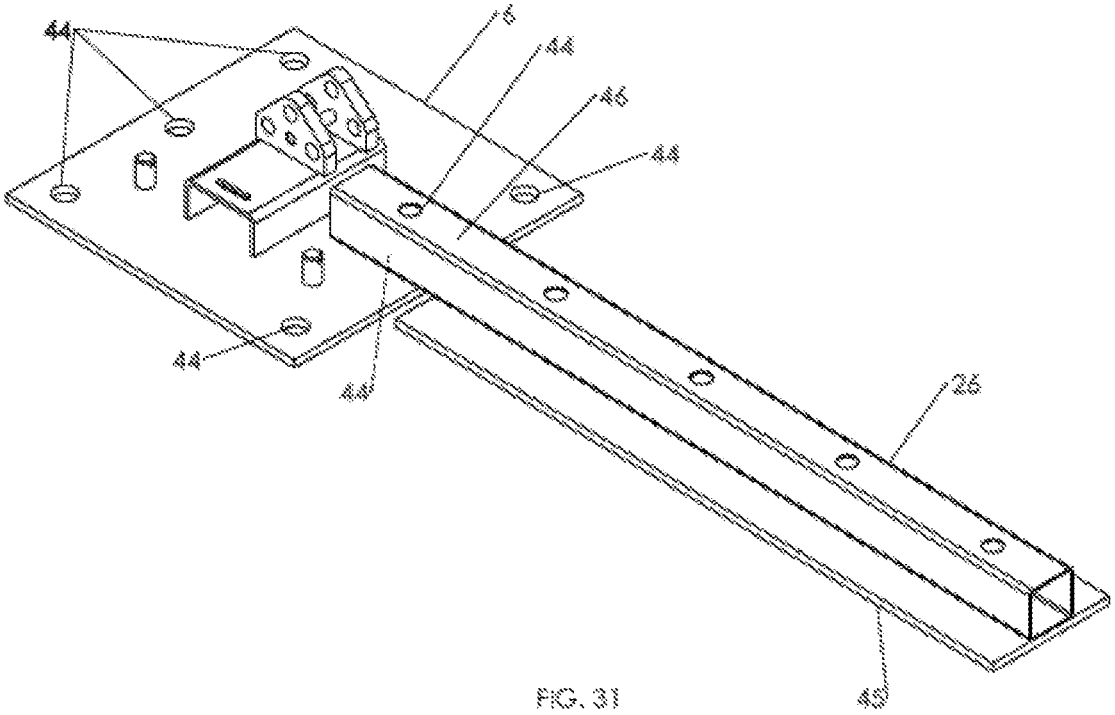
FIG. 31 shows an exemplary stake bar connection for the clearspan structure.

With reference now to FIGS. 30-31, the exemplary embodiment of a clearspan structure may further include stake bars 26 used with base plates 6 to increase resistance to uplift or shear forces on the clearspan structure 1. As shown in the exemplary embodiment of FIGS. 30-31, each stake bar 26 has additional anchoring apertures 44 for securing the stake bar 26 to a foundation or the ground.

As also shown in the exemplary embodiment of FIGS. 30-31, stake bar 26 includes stake bar platform 45 which elevates the stake bar 26 such that an overlapping portion 46 of stake bar 26 overlaps base plate 6. In this embodiment, overlapping portion 46 of stake bar 26 includes at least one anchoring aperture 44 that is aligned with an anchoring aperture 44 in base plate 6 such that an anchor may connect the stake bar 26 to each of the base plate 6 and a foundation or the ground. In this or other embodiments, base plates 6 may be integrally formed with stake bars 26 or connected by welding, bolting, or other known methods. Base plates 6 and stake bars 26 may also take any form or shape consistent with this disclosure.

In the exemplary embodiments, stake bars 26 are made from a galvanized steel such as according to standard A922 ("Standard Specification for Silicon Metal"). In other embodiments, stake bars may be made from other metals, alloys, plastics, or other materials consistent with this disclosure.

With reference now to FIGS. 1-2 and 32-35, the exemplary disclosed embodiment of a clearspan structure 1 may include cable braces 27 for providing additionally stability or resilience to the structure 1. An overall, exemplary configuration of cable braces 27 in the clearspan structure 1 may be seen in FIGS. 1 and 2. As shown in the exemplary embodiments of FIGS. 32-35, each cable brace 27 comprises a cable 28, turnbuckle 29, and cable console 30. In the exemplary embodiments of FIGS. 32-35, cable consoles 30 are bolted to frame members of the clearspan structure 1, and cables 28 are attached to the consoles using bolts through the eye end of an adjustable turnbuckle 29. Other known cable structures consistent with this disclosure may also be used.

Figure 32:
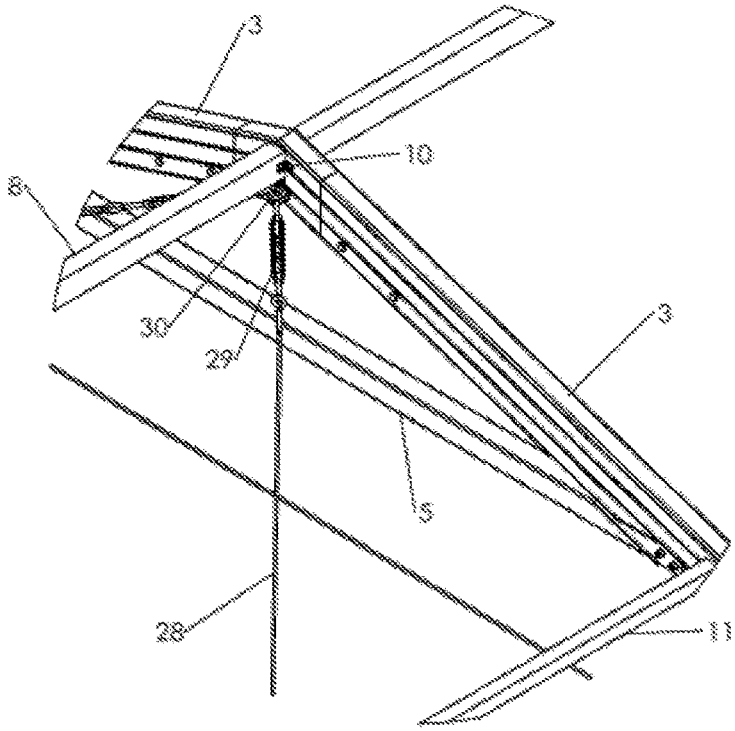
FIG. 32 shows an exemplary cable brace for the clearspan structure.
Figure 33:
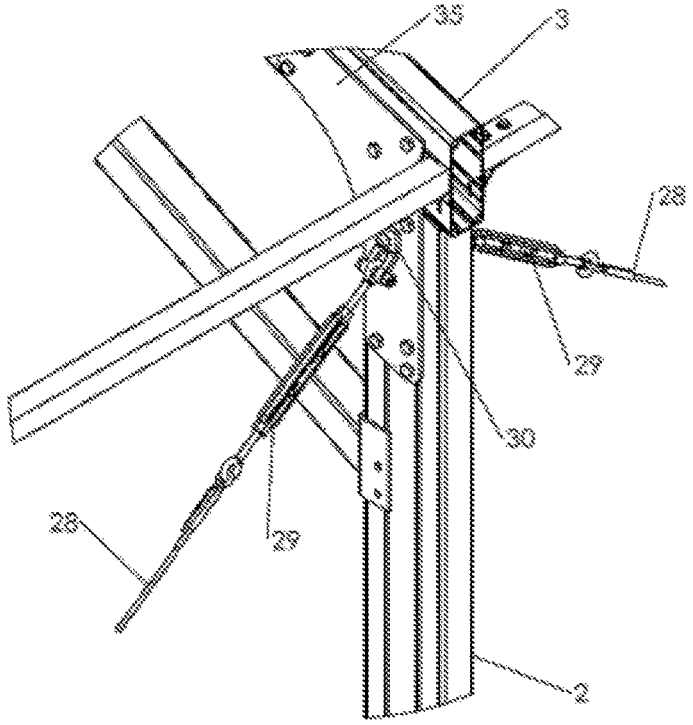
FIG. 33 shows an exemplary cable brace for the clearspan structure.
Figure 34:
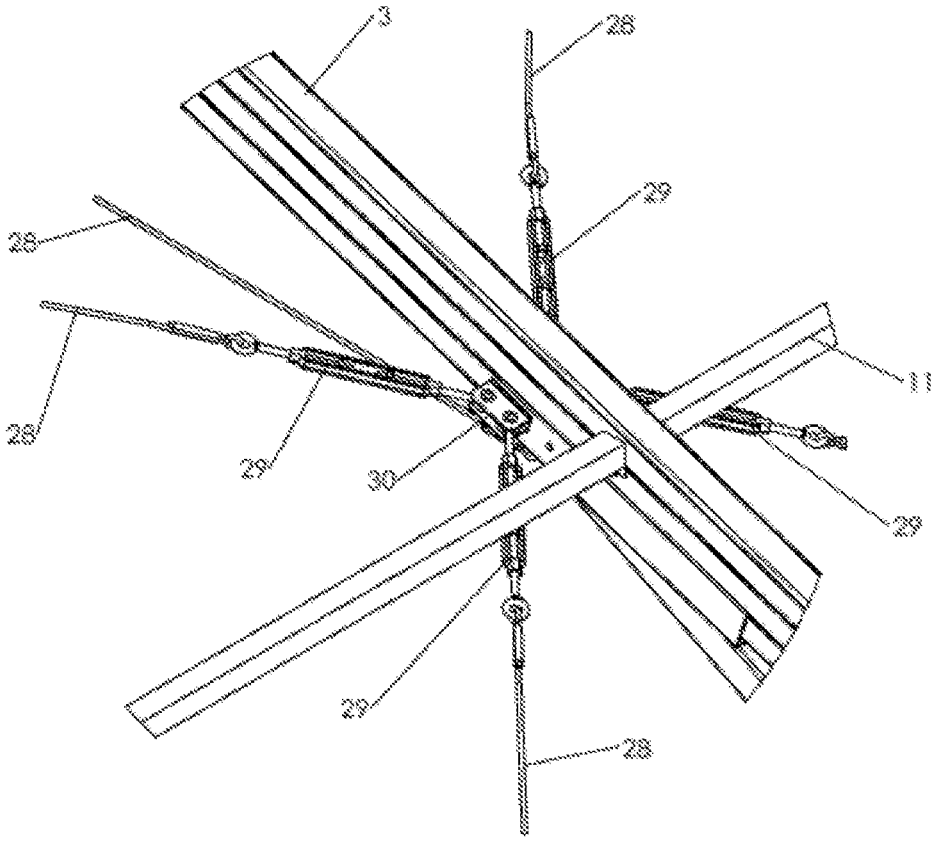
FIG. 34 shows an exemplary cable brace for the clearspan structure.
Figure 35:
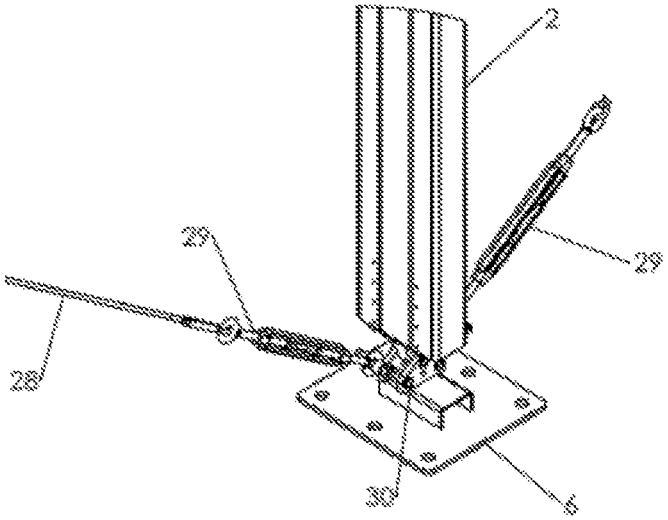
FIG. 35 shows an exemplary cable brace for the clearspan structure.

FIGS. 32-35 show cable brace 27 attachments at various locations in the clearspan structure 1. For example, FIG. 32 shows a cable console 30, turnbuckle 29, and cable 28 connected to rafters 3 at their intersection with a ridge purlin 8. FIG. 33 shows cable consoles 30, turnbuckles 29, and cables 28 connected to a bracket 35 joining an upright post 2 to a rafter 3. FIG. 34 shows cable consoles 30, turnbuckles 29, and cables 28 connected to a rafter 3 near an intermediate purlin 11. FIG. 35 shows a cable console 30, turnbuckles 29, and cables 28 connected to a base plate 6 beneath an upright post 2.

In the exemplary embodiments of FIGS. 32-35, cable braces 27 have steel bracing cables and components. In the same or other embodiments, the cable braces 27 may be formed from any suitable material, and connected at any particular locations, depending on the requirements for particular clearspan structures.

Figure 36:
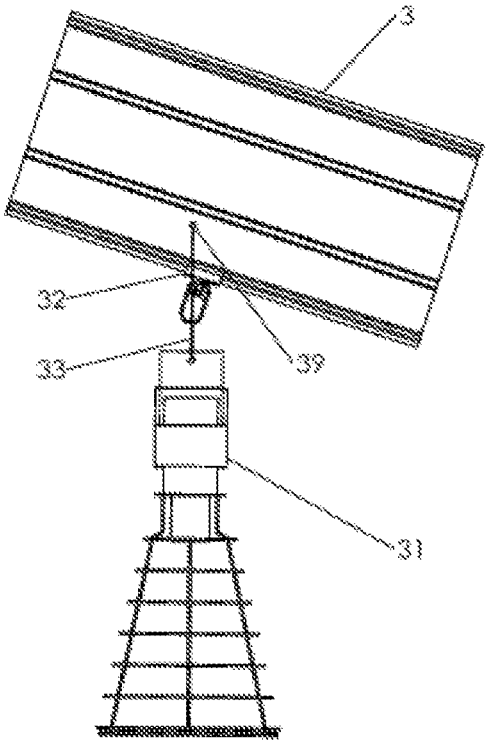
FIG. 36 shows an exemplary hanging light assembly for a clearspan structure.
Figure 37:
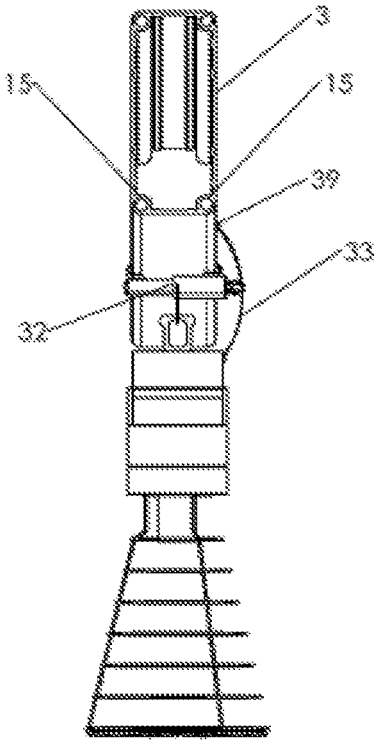
FIG. 37 shows an exemplary hanging light assembly for a clearspan structure; and, FIG. 38 shows an exemplary hanging light assembly for a clearspan structure.
Figure 38:
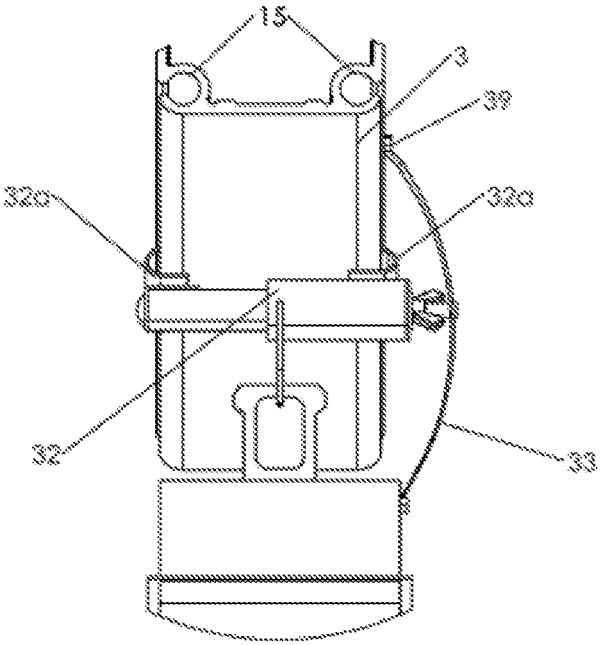

With reference now to FIGS. 36-38, the exemplary embodiment of a clearspan structure may further include a hanging light assembly 31. The hanging light assembly 31 is connected to a rafter 3 by a beam clamp 32 that is fastened to a keder track 15 on the bottom of the rafter 3 and a backup system consisting of a cable 33 connecting the light assembly 31 to the rafter 3. The hanging light assembly 31 may provide light within the clearspan structure, for example using a 400 watt metal halide light or other light source consistent with this disclosure.

In the exemplary embodiment shown by FIGS. 36-38, beam clamp 32 is a length-adjustable screw clamp with claws 32*a* configured to fit within and be clamped to keder tracks 15 of rafter 3. The exemplary cable 33 connecting the light assembly 31 to the rafter 3 is, in the exemplary embodiment, an 18 inch lanyard constructed out of a size No. 14 steel jack chain that is fastened to the side of the rafter with a size No. 14 self-tapping screw 39. In other embodiments, the hanging light assembly 31 may be secured to a frame member by any known means consistent with this disclosure, such as other clamping systems and mechanical connectors made from different materials, or means such as welding and screw/bolt-type fasteners.

An exemplary method of forming the disclosed exemplary clearspan structure will be generally understood from the foregoing description of an exemplary clearspan structure and component systems, and the materials, techniques, constructions, and assemblies described therein. The exemplary method includes securing stake bars 26 and base plates 6 to each other and to a foundation or the ground; connecting a first end of upright posts to base plates 6; connecting a second end upright posts 2 to a first end of rafters 3; connecting a second end of rafters 3 to ridge purlins 8; connecting eave purlins 7 to the first ends of rafters 3; connecting intermediate purlins 11 to rafters 3 in between the eave purlins 7 and ridge purlins 8; connecting brace bars 4 between connected upright posts 2 and rafters 3; and, connecting ridge struts 5 between opposing rafters 3.

The exemplary method may further comprise connecting fabric walls 19 to eave purlins 7; connecting roof fabrics 13 to rafters 3; and connecting roof fabric flaps 47 to ratchet straps 52 connected to upright posts.

The exemplary method may further comprise at least one of connecting cable braces 27 to frame members and connecting hanging light assemblies 31 to rafters 3.

In the exemplary or other embodiments, the method steps may be performed in any order, or not at all, consistent with this disclosure. Additional or alternative steps may also be performed within the scope of this disclosure, including the materials, techniques, constructions, and assemblies described with respect to the exemplary clearspan structure and component systems.

Although certain example embodiments have been described above, the present disclosure is not limited thereto. Also, the features, aspects, advantages, and example embodiments described herein may be combined to realize yet further embodiments. Further, the current disclosure covers various modifications and equivalent arrangements and methods included within the spirit and scope of the appended claims.

The invention claimed is:

1. A clearspan structure, comprising:

a first upright post having a first end and an opposing second end;

a second upright post having a third end and an opposing fourth end;

a first rafter having a fifth end and an opposing sixth end;

a second rafter having a seventh end and an opposing eighth end;

a first brace bar having a ninth end and an opposing tenth end;

a second brace bar having an eleventh end and an opposing twelfth end;

a first bracket;

a second bracket;

the second end of the first upright post being removably connectable to the fifth end of the first rafter;

the fourth end of the second upright post being removably connectable to the seventh end of the second rafter;

the sixth end of the first rafter being removably connectable to the eighth end of the second rafter;

the ninth end of the first brace bar being removably connectable to the first upright post between the first end and the second end;

the tenth end of the first brace bar being removably connectable to the first rafter between the fifth end and the sixth end;

the eleventh end of the second brace bar being removably connectable to the second upright post between the third end and the fourth end;

the twelfth end of the second brace bar being removably connectable to the second rafter between the seventh end and the eighth end;

the first bracket configured to be removably attached to the second end of the first upright post and the fifth end of the first rafter; and the second bracket configured to be removably attached to the fourth end of the second upright post and the seventh end of the second rafter;

wherein the clearspan structure comprises two configurations, the first configuration being a disassembled configuration and the second configuration being an operative configuration.

2. The clearspan structure of claim 1, when in the operative configuration, being devoid of additional vertical support between the first and second upright posts.

3. The clearspan structure of claim 1, further including a first base plate and a second base plate, the first base plate being removably connectable to the first end and the second base plate being removably connectable to the third end.

4. The clearspan structure of claim 1, the first upright post and the second upright post each being rectilinear from end-to-end.

5. The clearspan structure of claim 1, the first rafter and the second rafter each being rectilinear from end-to-end.

6. The clearspan structure of claim 1, the first brace bar and the second brace bar each being rectilinear from end-to-end.

7. The clearspan structure of claim 1, the first upright post, the second upright post, the first rafter, the second rafter, the first brace bar, and the second brace bar each being rectilinear from end-to-end.

8. A clearspan structure, comprising:

a first upright post having a first end and an opposing second end;

a second upright post having a third end and an opposing fourth end;

a first rafter having a fifth end and an opposing sixth end;

a second rafter having a seventh end and an opposing eighth end;

a first brace bar having a ninth end and an opposing tenth end;

a second brace bar having an eleventh end and an opposing twelfth end;

the second end of the first upright post being removably connectable to the fifth end of the first rafter;

the fourth end of the second upright post being removably connectable to the seventh end of the second rafter;

the sixth end of the first rafter being removably connectable to the eighth end of the second rafter;

the ninth end of the first brace bar being removably connectable to the first upright post between the first end and the second end;

the tenth end of the first brace bar being removably connectable to the first rafter between the fifth end and the sixth end;

the eleventh end of the second brace bar being removably connectable to the second upright post between the third end and the fourth end;

the twelfth end of the second brace bar being removably connectable to the second rafter between the seventh end and the eighth end; and a first base plate and a second base plate, the first base plate being removably connectable to the first end of the first upright post and the second base plate being removably connectable to the third end of the second upright post.

9. The clearspan structure of claim 8, further including first and second brackets, the first bracket configured for removable attachment to the second end and the fifth end, the second bracket configured for removable attachment to the fourth end and the seventh end.

10. The clearspan structure of claim 8, further including a flexible substrate configured to be carried by the structure and, when the clearspan structure is in operative configuration, disposed above the first and second upright posts, the first and second rafters, and the first and second brace bars.

11. The clearspan structure of claim 8, further including a waterproof flexible substrate configured to be carried by the structure, and when the clearspan structure is in operative configuration, disposed above the first and second rafters.

12. The clearspan structure of claim 8, wherein the clearspan structure is a first clearspan structure and further including a second clearspan structure identical to the first clearspan structure, the second clearspan structure including a third upright post, a fourth upright post, a third rafter, a fourth rafter, a third brace bar, and a fourth brace bar.

13. The clearspan structure of claim 8, wherein the clearspan structure is a first clearspan structure and further including a second clearspan structure identical to the first clearspan structure including, a third upright post, a fourth upright post, a third rafter, a fourth rafter, a first purlin with a thirteenth end and a fourteenth end, a second purlin with a fifteenth end and a sixteenth end, the thirteenth end being removably connectable to one of the first upright post and the first rafter and the fourteenth end being removably connectable to one of the third upright post and the third rafter, the fifteenth end being removably connectable to one of the second upright post and the second rafter, and the sixteenth end being removably connectable to one of the fourth upright post and the fourth rafter.

14. The clearspan structure of claim 13, further including a first cable having a seventeenth end and an eighteenth end, a second cable having a nineteenth end and a twentieth end, the seventeenth end being removably connectable to the first upright post, the eighteenth end being removably connectable to one of the third upright post and the third rafter, and the nineteenth end being removably connectable to the third upright post and the twentieth end being removably connectable to one of the first upright post and the first rafter.

15. A clearspan structure, comprising:

an upright post being substantially rectilinear from end-to-end;

a rafter being substantially rectilinear from end-to-end;

a brace bar being substantially rectilinear from end-to-end having a first end and an opposing second end;

a bracket;

a flexible substrate;

the upright post being attached to the rafter end-to-end;

the first end of the brace bar being attached to the upright post;

the second end of the brace bar being attached to the rafter;

the bracket being attached to the upright post and the rafter at a respective attachment point thereof; and the flexible substrate positioned above the upright post, the rafter, the bracket, and the brace bar.

16. A clearspan structure, comprising:

a first base plate;

a second base plate;

a third base plate;

a fourth base plate;

a first upright post having a first end and an opposing second end;

a second upright post having a third end and an opposing fourth end;

a third upright post having a fifth end and an opposing sixth end;

a fourth upright post having a seventh end and an opposing eighth end;

a first rafter having a ninth end and an opposing tenth end;

a second rafter having an eleventh end and an opposing twelfth end;

a third rafter having a thirteenth end and an opposing fourteenth end;

a fourth rafter having a fifteenth end and an opposing sixteenth end;

a first brace bar having a seventeenth end and an opposing eighteenth end;

a second brace bar having a nineteenth end and an opposing twentieth end;

a third brace bar having a twenty-first end and an opposing twenty-second end;

a fourth brace bar having a twenty-third end and an opposing twenty-fourth end;

the first end of the first upright post removably connected to the first base plate;

the second end of the first upright post removably connected to the ninth end;

the third end of the second upright post removably connected to the second base plate;

the fourth end of second upright post removably connected to the eleventh end of the second rafter;

the tenth end of the first rafter removably connected to the twelfth end of the second rafter;

the fifth end of the third upright post removably connected to the third base plate;

the sixth end of the third upright post removably connected to the thirteenth end of the third rafter;

the seventh of the fourth upright post end removably connected to the fourth base plate;

the eighth end of the fourth upright post removably connected to the fifteenth end of the fourth rafter;

the fourteenth end of the third rafter removably connected to the sixteenth end of the fourth rafter;

the seventeenth end of the first brace bar removably connected to the first upright post between the first end and the second end;

the eighteenth end of the first brace bar removably connected to the first rafter between the ninth end and the tenth end;

the nineteenth end of the second brace bar removably connected to the second upright post between the third end and the fourth end;

the twentieth end of the second brace bar removably connected to the second rafter between the eleventh end and the twelfth end;

the twenty-first end of the third brace bar removably connected to the third upright post between the fifth end and the sixth end;

the twenty-second end of the third brace bar removably connected to the third rafter between the thirteenth end and the fourteenth end;

the twenty-third end of the fourth brace bar removably connected to the fourth upright post between the seventh end and the eighth end; and the twenty-fourth end of the fourth brace bar removably connected to the fourth rafter between the fifteenth end and the sixteenth end.

17. The clearspan structure of claim 16, the first, second, third, and fourth upright posts being parallel one-to-another.

18. The clearspan structure of claim 16, further including a first strut having a twenty-fifth end and an opposing twenty-sixth end, a second strut having a twenty-seventh end and an opposing twenty-eighth end, the twenty-fifth end removably connected to the first rafter between the ninth end and the tenth end, the twenty-sixth end removably connected to the second rafter between the eleventh end and the twelfth end, the twenty-seventh end removably connected to the third rafter between the thirteenth end and the fourteenth end, and the twenty-eighth end removably connected to the fourth rafter between the fifteenth end and the sixteenth end.

19. The clearspan structure of claim 16, the first rafter and third rafter being parallel one-to-another residing at an acute angle relative to horizontal, the second rafter and the fourth rafter being parallel one-to-another residing at an acute angle relative to horizontal.

20. The clearspan structure of claim 16, further including a flexible substrate carried by and disposed above the structure.

21. A method of assembling a clearspan structure, comprising the steps of:

a) providing the clearspan structure of claim 1, b) connecting the second end to the fifth end, c) connecting the fourth end to the seventh end, d) connecting the sixth end to the eighth end;

e) connecting the ninth end to the first upright post between the first end and the second end, f) connecting the tenth end to the first rafter between the fifth end and the sixth end, g) connecting the eleventh end to the second upright post between the third end and the fourth end, and h) connecting the twelfth end to the second rafter between the seventh end and the eighth end.

* * * * *